United States Patent [19]

Blanchette et al.

[11] 4,051,923

[45] Oct. 4, 1977

[54] CABLELESS CAGE ELEVATOR

[76] Inventors: Lionel Blanchette; Adrien André Blanchette, both of 550 Decarie Boulevard, Apt. 6, Saint Laurent, Canada, H4L 3K9

[21] Appl. No.: 734,256

[22] Filed: Oct. 20, 1976

[51] Int. Cl.[2] ..... B66B 9/02

[52] U.S. Cl. ..... 187/25; 74/342

[58] Field of Search ..... 187/25, 24, 19; 74/625, 74/342, 425, 331, 359, 361

[56] References Cited

U.S. PATENT DOCUMENTS

| | | | |
|---|---|---|---|
| 47,761 | 5/1865 | Willard | 187/25 |
| 679,142 | 7/1901 | Farmer | 187/25 |
| 790,137 | 5/1905 | Karrer | 187/25 |
| 828,029 | 8/1906 | Jackson | 187/25 |
| 920,630 | 5/1909 | Ocumpaugh | 187/25 |
| 1,392,078 | 9/1921 | Ouillett | 187/25 |
| 1,852,134 | 4/1932 | Sweet | 74/405 |
| 2,724,289 | 11/1955 | Wight | 74/625 |

*Primary Examiner*—John J. Love
*Assistant Examiner*—Jeffrey V. Nase

[57] ABSTRACT

A cage elevator of the cableless type which is particularly simple, safe and reliable; which forms a simple, compact and sturdy frame, cage, drive units and threaded cylinder sections combination; which may be easily extended to any height without alteration nor displacement of the other components; which has positive, neat and strong gear engagement in particular in internally threaded posts, thus offering the advantage to use square threads for self-braking; which includes a simple and convenient manual drive assembly to safely reach an exit door upon electrical power failure; and which includes guideways positively guiding the elevator cage laterally for reduced wear on the threads directly associated with the vertical travel. The cylinder sections are slotted and a frame carries the cage, a pair of drive units and gear drives operatively connected to worms in the threaded slotted cylinder sections, the cylinder sections are fitted in end-to-end relation in upright channels and each cylinder section can be removed from the channel independently of the other cylinder sections for ease of maintenance.

2 Claims, 4 Drawing Figures

CABLELESS CAGE ELEVATOR

This invention relates to a cage elevator of the cableless type, that is wherein the elevator cage is not suspended by cables and does not use counterweights.

Cage elevators of the above type have so far been proposed but they have not been found suitably safe and reliable alternatives to the common cable elevator.

It is a general object of the present invention to provide a cableless cage elevator which is simple, reliable and safe and constitutes a suitable alternative to the common cable elevator.

It is another general object of the present invention to provide a cableless cage elevator which includes a simple, compact and sturdy frame, cage, drive units and threaded cylinders combination.

It is another object of the present invention to provide a cableless cage elevator including guide cylinders which may be easily and readily extended to any height without alteration nor displacement of the other components.

It is another object of the present invention to provide a cableless cage elevator with a neat, strong and positive gear engagement and which is particularly adapted for the use of square threads for self-braking.

It is a further object of the present invention to provide a cableless cage elevator which may be simply and conveniently manually operated to reach an exit door upon electrical power failure, and in particular, to be lowered to the next story down for safe exit.

It is still another object of the present invention to provide a cableless cage elevator which includes a simple gear drive and clutch arrangement to provide reversed drives and an unclutched condition upon de-energization of the normal drive unit.

It is a still further object of the present invention to provide a cableless cage elevator with positive lateral guiding for reduced wear on the gears directly associated with the vertical travel as well as extra stability in vertical travel.

The above and other objects and advantages of the present invention will be better understood with reference to the following detailed description of a preferred embodiment thereof which is illustrated, by way of example, in the accompanying drawings, in which.

Figure 2:
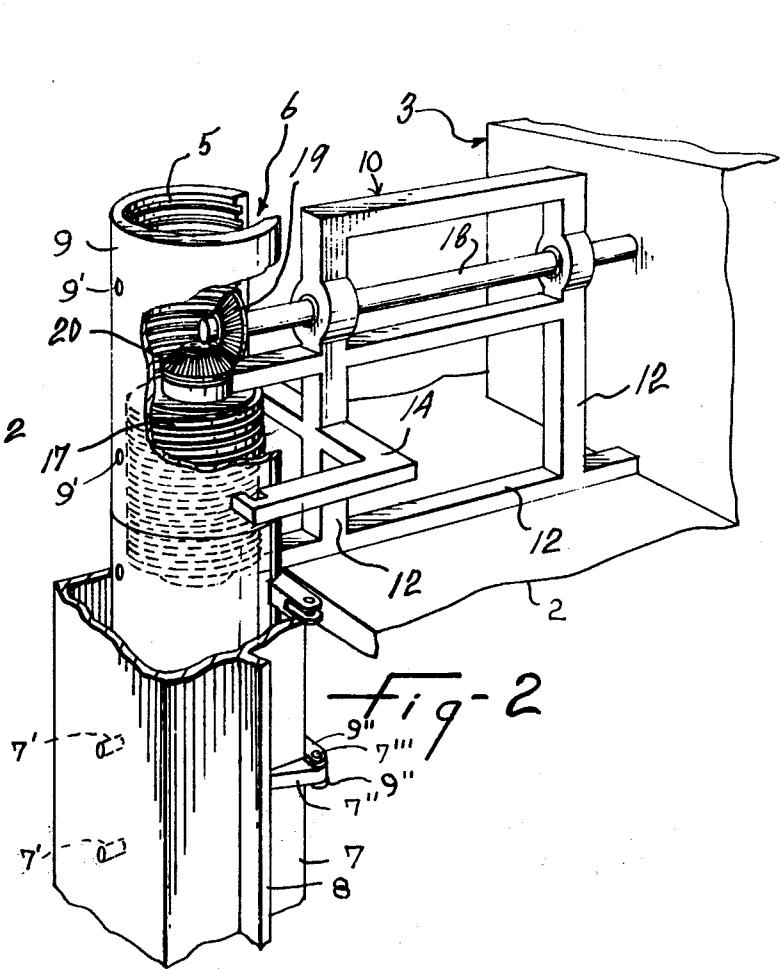
FIG. 2 is a perspective view with parts broken away of a portion of FIG. 1, specifically a back view of the right-hand cylinder and channel assembly illustrating the details of the internally threaded cylindrical sections.
Figure 1:
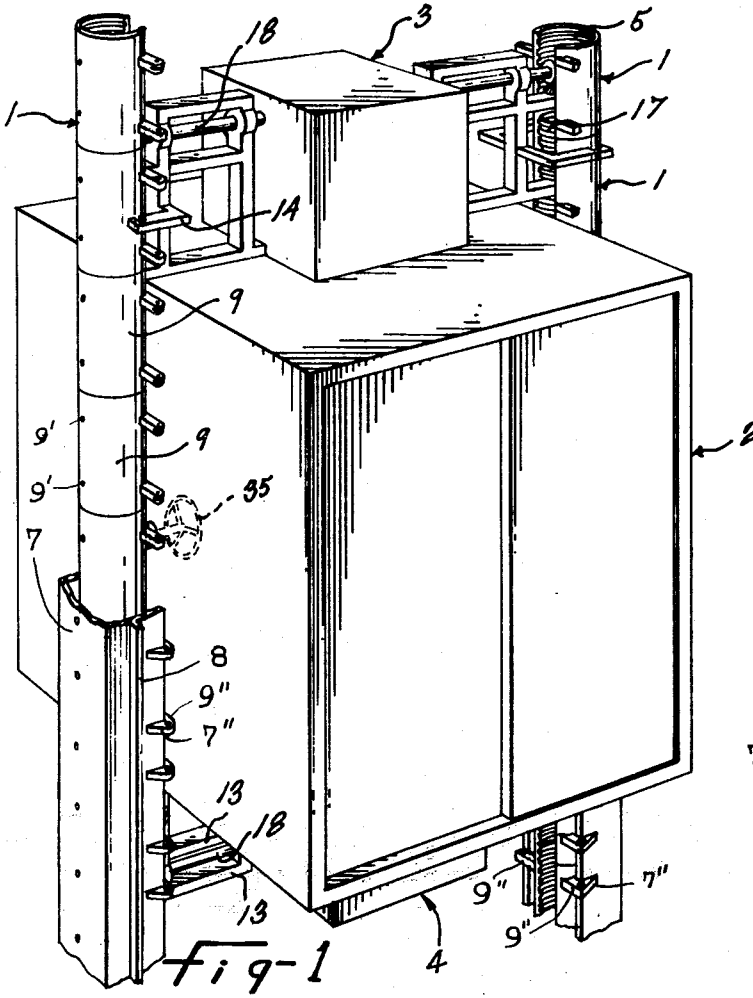
FIG. 1 is a perspective view of a cableless cage elevator according to the present invention.
Figures 3, 4:
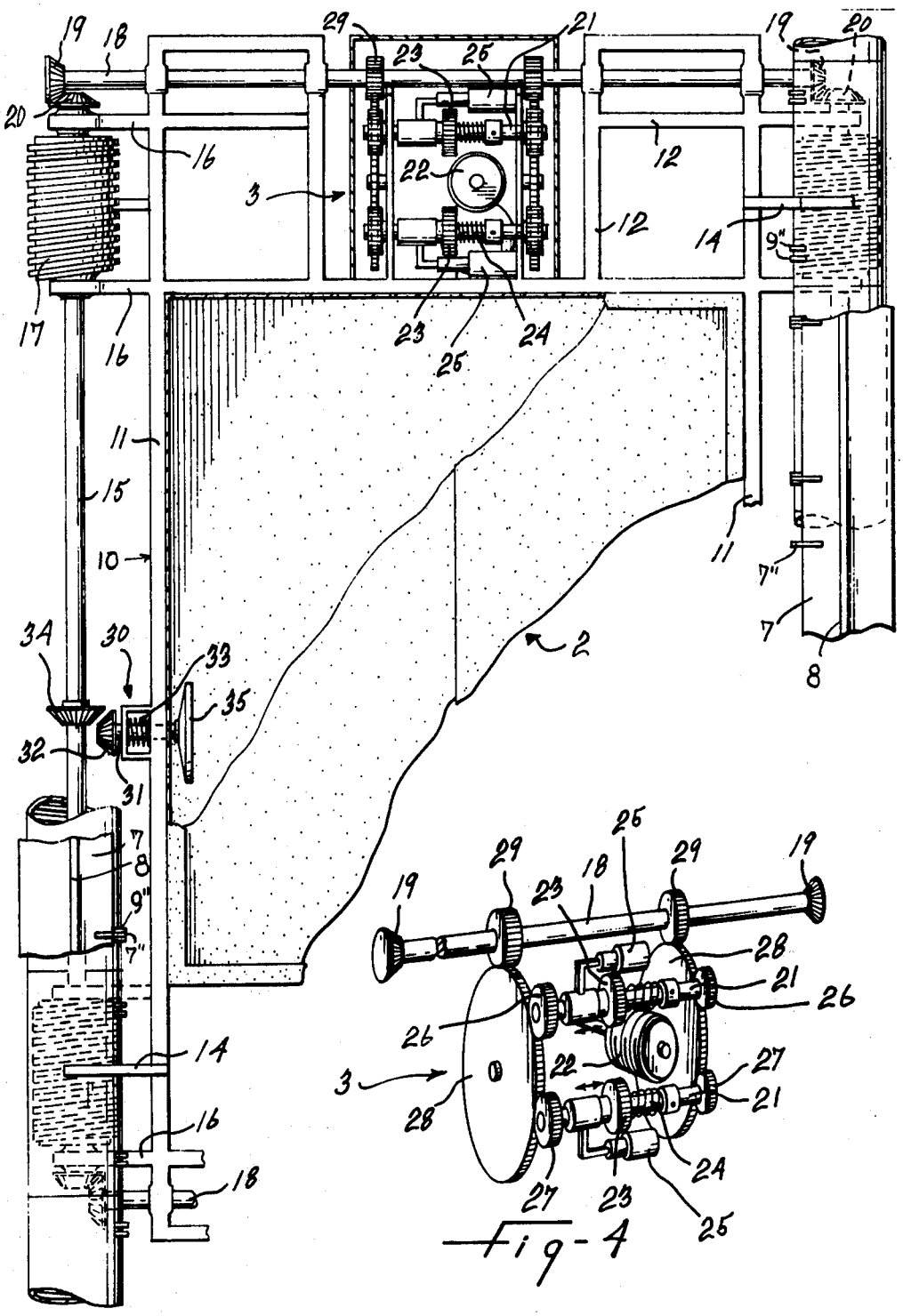
FIG. 3 is an elevation view with parts broken away of the greater part of the elevator.
FIG. 4 is a perspective view of a drive unit to actuate the elevator, of which there are two units: one on the top and one at the bottom of the elevator cage, as seen in FIG. 1.

The illustrated cableless cage elevator includes a pair of laterally spaced-apart and internally threaded upright cylinders 1, an elevator cage 2 and a pair of drive units 3 and 4 to displace the cage along the cylinders.

Each cylinder 1 is formed with internal square threads 5 and has a slot 6 extending longitudinally thereof and having a width not more than one-third of the periphery of cylinder 1. Each cylinder 1 is formed of a series cylindrical sections 9 in end to end abutment and having complementary internal square threading to form a continuous internal square thread. Each cylindrical section 9 is removably fitted in a vertical structural channel 7 opened towards cage 2 to removably receive cylindrical sections 9. The web of channel 7 has a series of locating pins 7' to fit in localizing holes 9' of cylindrical sections 9. These locating pins 7' are provided to properly align and center the cylindrical sections 9 in channel 7 and, thus, ensure the continuity of the internal threads 5. Sections 9 are individually secured within channel 7 by means of lugs 7'' protruding from each side of channel 7 engaging between ears 9'' secured to each side of each cylindrical section 9. Locking pins 7''' are removably inserted into aligned holes of lugs 7'' and ears 9''. Thus, any cylindrical section 9 can be replaced when its internal threads 5 are worn out or damaged, without tampering with the other sections 9 which assures easy maintenance.

Channel 7 has a pair of guiding ridges 8 extending longitudinally on each side thereof. Channels 7 are intended to be fixed to the said walls of an elevator shaft by any means, not shown. Several channels can be fitted in end-to-end relation depending on the height of the elevator shaft.

A planar and rectangular vertical frame 10 is provided to operatively carry the elevator cage 2 relative to the upright cylinders 1. The frame 10 includes a pair of laterally space-apart upright sides 11, a top frame portion 12 and a bottom frame portion 13 cooperatively defining a rectangular central space or aperture in which is mounted the elevator cage 2.

U-shape shackles are fixed to the frame portions 12 and 13 and cooperate with the guide ridges 8 to positively guide the elevator cage 2. Each U-shape shackle includes a pair of legs 14 straddling the corresponding channel 7 and forming mutually facing notches engaged by corresponding guide ridges 8 for guided sliding of the U-shape shackles in engagement with these ridges.

In each upright cylinder 1, there is mounted an upright shaft 15 rotatably carried by lateral projections 16 of the frame portions 12 and 13. Lateral projections 16 extend freely through slots 6. A pair of square threaded conveyor worms 17 are fixed to each shaft 15 and axially spaced from each other along the same upright shaft. Projections 16 support shaft 15 at each end of each worm 17. The worms 17 operatively mesh with the internal threads of the upright cylinders 1 to travel along the latter upon rotation of said worms 17. Top and bottom transverse drive shafts 18 are rotatably carried by the frame portions 12 and 13 respectively. The ends of the drive shafts 18 extend into the upright cylinders 1 through the slot 6 and are connected to the upright shafts 15 by bevel gears 19 and 20.

Each of the afore-mentioned drive units 3 and 4 includes a motor, not shown, a pair of output shafts 21 extending in parallel spaced-apart relationship, a driving worm 22 driven by the corresponding motor and axially extending on a transverse axis between the output shafts 21, and a pair of secondary gears 23 slidably splined on the corresponding output shafts respectively. The secondary gears 23 are slidable along the output shafts 21 and biased each by a spring 24 toward an unclutched position axially away from the corresponding driving worm 22. A solenoid 25 is connected to each sliding secondary gear 23 to displace either of the two secondary gears of each drive unit 3 and 4 to a clutching position defined by engagement of one gear with the driving worm 22. Thus, either shaft 21 of each drive unit may be driven by the worm 22 to produce bodily rotation of the output gears 26 or 27. The arrangement of the secondary gears 23 relative to the driving worm results in rotation of these gears in reverse relative to each other. The output gears 26 thus also rotate in reverse relative to the output gears 27. The large gears 28 may thus be selectively rotated in either direction.

The gears 28 constantly mesh with driving gears 29 fixedly secured on the corresponding transverse shaft 18. Consequently, the upright shafts 15 and the worms 17 may be selectively rotated in either direction for selective elevation and lowering of the frame 11-12-13 and the elevator cage 2.

It must be noted that each secondary gear 23 is slidably biased to an unclutched position such that if there is an electrical power failure, these gears 23 are disengaged and the gear drives and the worms 17 may be rotated independently of the inactivated motor. For this purpose, there is provided a manual drive assembly 30 including a shaft 31 outwardly projecting through the wall of the cage 2, a bevel gear 32 on the outer end of the shaft 31 and a spring 33 biasing the shaft 31 inwardly to unclutching position of the bevel gear 32 relative to an associated bevel gear 34 fixed to one corresponding upright shaft 15. The manual drive assembly also includes a handwheel 35 fixed to the inner end of the shaft 31 inside the elevator cage 2. Thus, upon power failure, the handwheel 35 is axially pushed outwardly and rotated to produce engagement of the bevel gear 32 with the bevel gear 34 and a corresponding rotation of the shafts 15, worms 17, transverse shafts 18 and the gear drives 19-20, and 26-29 to permit lowering of the elevator cage down to the next floor for safe exit.

The two drive units 3 and 4 may be operated at the same time or one may be used as a spare in case of failure of the other.

What we claim is:

1. A cableless elevator system comprising a pair of laterally spaced-apart upright channels, each adapted to be secured to a side wall of an elevator shaft, each channel of U-shape construction and opening towards each other, a series of hollow cylindrical sections removably fitted within each channel in end-to-end abutment, a series of locating pins locating and centering each cylindrical section within the respective channels, lugs protruding from each side of each channel, ears protruding from said cylindrical sections and engaged by said lugs, said lugs and ears having aligned holes and locking pins removably inserted into said aligned holes of said lugs and ears, each cylindrical section having a longitudinally extending slot having a width not more than one-third of the periphery of the cylindrical section, the slots of the cylindrical sections being in alignment and forming a continuous slot facing towards the slot of the cylindrical sections of the other channel when the cylindrical sections are removably secured in proper position in each channel, each cylindrical section having an internal square thread forming a continuity with the square thread of adjacent cylindrical sections, the sides of each channel forming an externally protruding and longitudinally extending guide ridge, a rectangular and planar vertically extending frame disposed between each assembly of channels and cylindrical sections, an elevator cage fixed within said frame, two driver units mounted on said frame: one on top and one at the bottom of said elevator cage and each including a transversely extending drive shaft entering at both ends into the respective cylindrical cylinder sections through the respective slots, bevel gears secured to the ends of the respective transverse drive shaft, within said cylinder sections, frame extensions carried by said frame and extending through the respective slots above and below said cage, a vertical shaft rotatably carried by said frame extensions and located upright within the respective assemblies of cylinder sections, a pair of worms spacedly secured on each vertical shaft and in threaded engagement with the threads of the cylinder sections at the top and bottom of the frame, a bevel gear secured to the top and bottom of each vertical shaft and in respective meshing engagement with the bevel gears of each transverse shaft, each drive unit further including a separate power means for driving the respective transverse shaft and clutching and reversing mechanism for clutching and declutching the respective transverse shafts and for reversing the direction of rotation of the same, and U-shape shackles carried by said frame and respectively engagable with said guiding ridges of said channels at the top and bottom of said frame.

2. A cableless cage elevator as claimed in claim 1, wherein said clutching and rotation reversing mechanism of each drive unit includes a pair of laterally spaced-apart output shafts extending parallel to said transverse shafts, a driving worm axially extending between and transversely of the corresponding output shafts, a pair of secondary gears slidably splined on said output shafts respectively and axially displaceable for selective engagement with said driving worm, a spring axially biasing each secondary gear in unclutching direction relative to said driving worm, a pair of solenoids operatively connected to said secondary gears respectively and adapted to selectively mesh one of the latter with the corresponding driving worm, and gearing on said output shaft and the corresponding transverse drive shafts and in constant meshing engagement.

* * * * *